United States Patent [19]

Kumata et al.

[11] Patent Number: 4,696,617

[45] Date of Patent: Sep. 29, 1987

[54] APPARATUS FOR FEEDING BAR-LIKE MATERIALS

[75] Inventors: Katsuhiko Kumata; Isao Endo, both of Nagareyama; Syozi Numa, Tokyo; Ichiro Hirose; Takayoshi Sagawa, both of Hiratsuka; Katsuyoshi Matono, Fukuoka, all of Japan

[73] Assignees: Tokyo Automatic Machinery Works, Ltd.; Japan Tobacco, Inc., both of Tokyo, Japan

[21] Appl. No.: 659,217

[22] Filed: Oct. 10, 1984

[30] Foreign Application Priority Data

Oct. 18, 1983 [JP] Japan ..... 58-195749

[51] Int. Cl.[4] ..... B65G 65/23

[52] U.S. Cl. ..... 414/422; 414/405; 414/416; 414/421; 414/762; 414/765

[58] Field of Search ..... 414/405, 413, 416, 419, 414/421, 422, 786, 762, 764, 765, 766; 198/403; 53/381

[56] References Cited

U.S. PATENT DOCUMENTS

| | | | |
|---|---|---|---|
| 2,473,955 | 6/1949 | Kendall | 414/762 |
| 3,263,842 | 8/1966 | Holstein | 414/416 X |
| 3,486,647 | 12/1969 | Seragnoli | 414/419 X |
| 3,550,799 | 12/1970 | Marradi | 414/421 X |
| 3,598,268 | 5/1971 | Wallace | 414/413 |
| 3,774,791 | 11/1973 | Bornfleth | 414/421 |
| 3,861,543 | 1/1975 | Elsworth | 414/403 X |
| 4,303,366 | 12/1981 | Hinchcliffe et al. | 414/419 |
| 4,482,282 | 11/1984 | Wildmoser | 414/417 X |

FOREIGN PATENT DOCUMENTS

| | | | |
|---|---|---|---|
| 48-34919 | 10/1973 | Japan . | |
| 56-52880 | 12/1981 | Japan . | |
| 57-28640 | 6/1982 | Japan . | |
| 2128965 | 5/1984 | United Kingdom | 414/421 |

*Primary Examiner*—Frank E. Werner

*Attorney, Agent, or Firm*—Popper, Bobis & Jackson

[57] ABSTRACT

A method for feeding cigarettes or filter plugs or the like to a working machine, such as a transporting machine, using a flat feeding passage with a bottom which can store and convey the cigarettes etc. in the horizontal direction, comprising introducing receiving boxes containing the cigarettes etc. into the feeding passage and moving them to a feeding station, and raising the receiving boxes at the feeding station so that the cigarettes etc. in the receiving boxes are discharged at one time. The invention discloses also an apparatus for carrying out the method.

9 Claims, 10 Drawing Figures

| FIG. 1A | FIG. 1B |
|---|---|

| FIG. 2A | FIG. 2B |
|---|---|

| FIG. 7A | FIG. 7B |
|---|---|

| FIG. 8A | FIG. 8B |
|---|---|

APPARATUS FOR FEEDING BAR-LIKE MATERIALS

BACKGROUND OF THE INVENTION

1. Field of the Invention

This invention relates to a method for feeding bar-like materials, such as cigarettes or filter plugs, to a working machine, such as a transporting machine, and also relates to an apparatus for carrying out the method.

2. Description of the Prior Art

In known bar-like material feeding apparatuses which are disclosed, for example, in Japanese Examined Patent Publication No. 48-34919, or Japanese Examined Utility Model Publication Nos. 56-52880 and 57-28640, bar-like materials fall by their weight into a hopper which is provided on a horizontally extending belt conveyor and which carries thereon bar-like material receiving boxes in an inverted state, through bottom openings of the receiving boxes, so that the materials are fed onto the belt conveyor through the bottom of the hopper.

However, in the known apparatuses as mentioned above, a receiving box arranging station where the receiving boxes are arranged in an inverted state and a feeding station where the fall of the bar-like materials takes place are located at the same position, and accordingly, the commencement of the feeding operation of the bar-like materials takes place only after a blank box which has finished the discharge of the bar-like materials is discharged and then a subsequent receiving box is arranged in an inverted state on the hopper. These are, accordingly, time consuming operations. In addition to the foregoing, since the materials in the receiving boxes, fall by their weight to feed the same, it is rather difficult to increase the amount of materials to be fed at one time or to feed the materials at high speed.

Furthermore, since the materials fall by their weight through the bottom openings of the receiving boxes onto the stack of materials which have been already fed and stored in the hopper, the upper surface of the stack tends to be irregular. Accordingly, the materials which fall onto the stack may be caught by the convex portion of the irregular upper surface of the stack or may come in the concave portion of the upper surface of the stack so that they are inclined with respect to the vertical. As a result of this, no smooth and quick feed can be expected.

SUMMARY OF THE INVENTION

The primary object of the present invention is, therefore, to eliminate the abovementioned drawbacks of the prior art, by using a flat feeding passage with a bottom which stores and transversely move the bar-like materials, in place of the existing hopper provided in the prior art apparatuses.

The material receiving boxes are moved in the feeding passage and are raised at a predetermined feeding station to feed a large amount of bar-like materials into the feeding passage at one time, thereby to ensure rapid and smooth feeding of the bar-like materials.

In order to achieve the object mentioned above, according to the invention, there is provided a method for feeding bar-like materials, comprising successively introducing bar-like material receiving boxes with open tops, in an inverted state, into a flat feeding passage with a bottom which is connected, at its one end, to a storing device, one by one, and then moving upward the frontmost receiving box which comes to a predetermined position in the feeding passage to feed the bar-like materials contained in the receiving box into the feeding passage.

According to another aspect of the present invention, there is provided an apparatus for feeding bar-like materials, comprising a feeding framework which forms a flat feeding passage with a bottom and which is provided, on its inlet end, with an arranging means for arranging bar-like material receiving boxes with open tops which receive the bar-like materials, in an inverted state, and a conveying means for successively conveying the inverted receiving boxes into the feeding passage one by one, an elevating means on the feeding framework for elevating the receiving boxes which reach a predetermined position in the feeding passage, and a discharging means on the feeding framework for discharging blank receiving boxes raised by the elevating means from the feeding framework.

The bottom of the feeding passage may be made of a stationary flat plate but preferably of a movable belt conveyor so that the receiving boxes and the bar-like materials can be smoothly conveyed.

The bar-like material receiving boxes can be made of a metal tray, or cardboard material or the like. The receiving boxes may be of lidless type or if they have lids, the top openings can be provided by opening the lid in use.

It should be noted that in the feeding method of the present invention mentioned above, the raising step of the receiving boxes includes not only moving upward the receiving boxes at the predetermined position in the vertical direction, but also moving upward the receiving boxes while conveying them toward the storing device. According to the present invention, since during the feeding operation of the bar-like materials, the receiving boxes for the subsequent bar-like materials to be introduced can be arranged in a predetermined state, the introduction of the receiving boxes can be efficiently effected, and since a large amount of bar-like materials are fed at one time, the feed of the bar-like materials can be effected at high speed, thus resulting in a quick feed of the bar-like materials.

Furthermore, since the amount of bar-like materials for one receiving box are fed onto the bottom of the feeding passage at one time, the posture of the bar-like materials during feeding is stable, unlike the prior art in which the materials fall by their weight onto the stack of the materials which have been fed, thus resulting in a smooth feeding of the bar-like materials.

BRIEF DESCRIPTION OF THE DRAWINGS

The invention will be described in detail below with reference to the accompanying drawings in which.

DESCRIPTION OF THE PREFERRED EMBODIMENT

Figures 1, 1B:
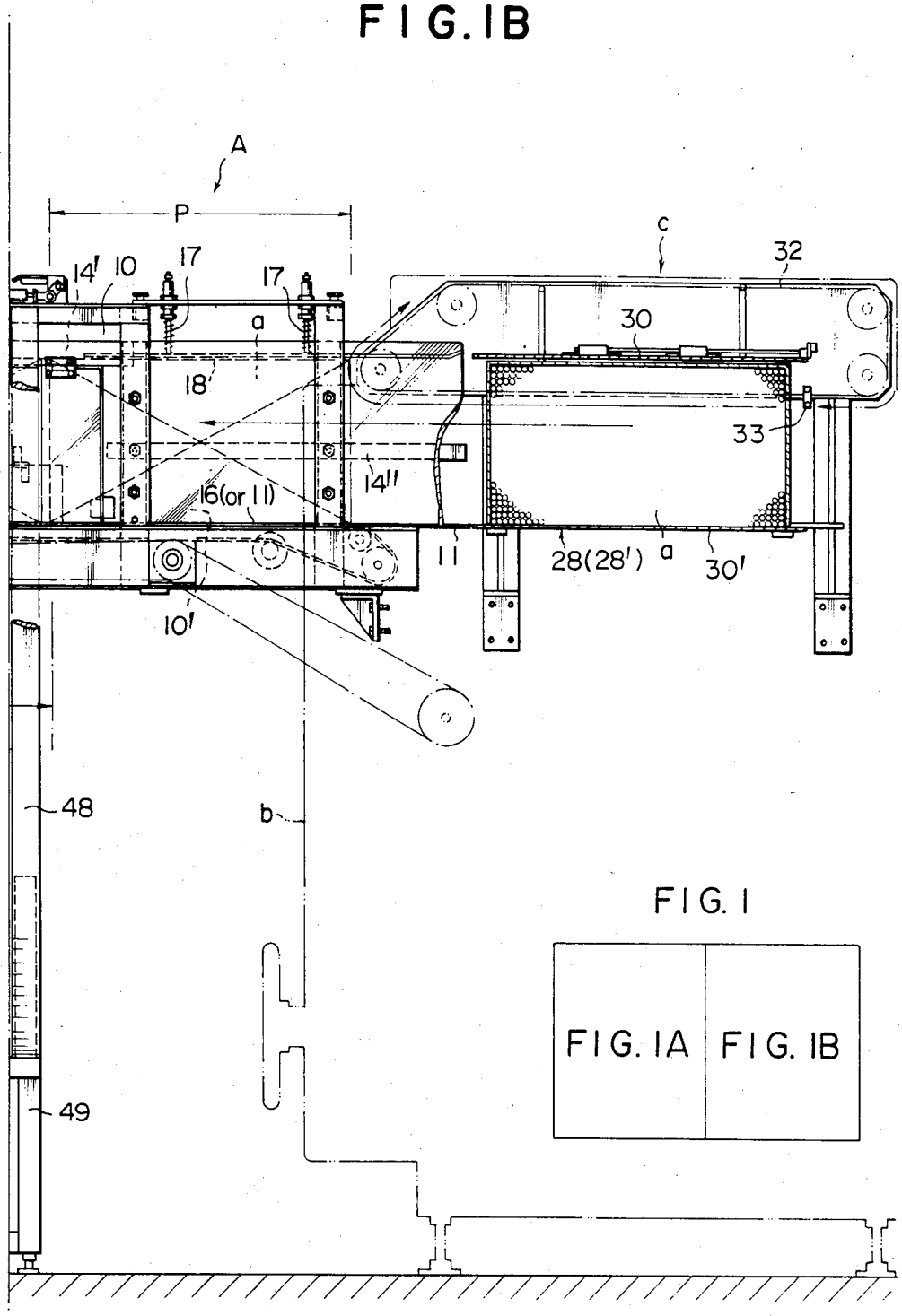
FIG. 1 is a partial front elevational view of a feeding apparatus, according to the present invention.
Figure 1A:
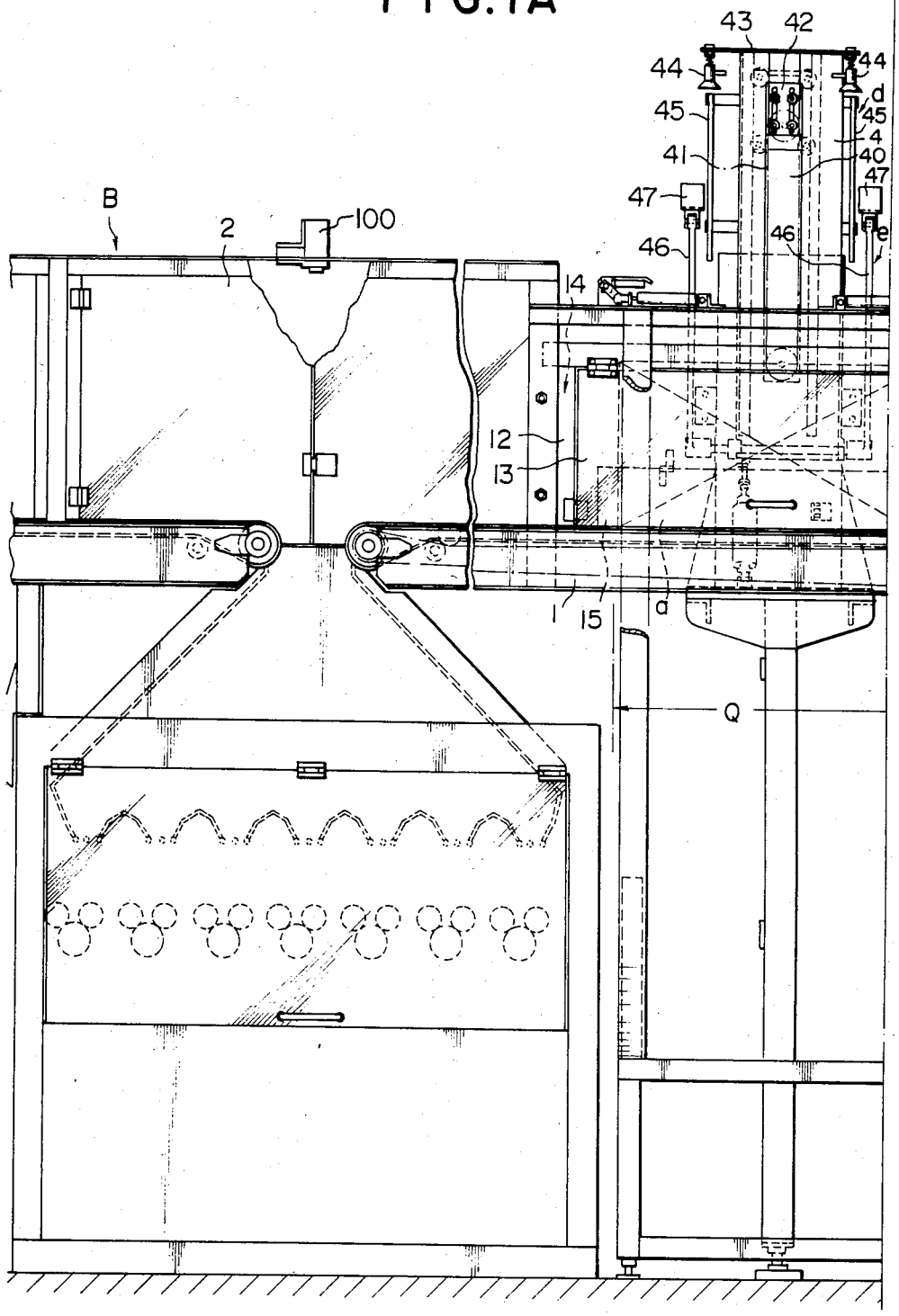
Figures 2, 2A:
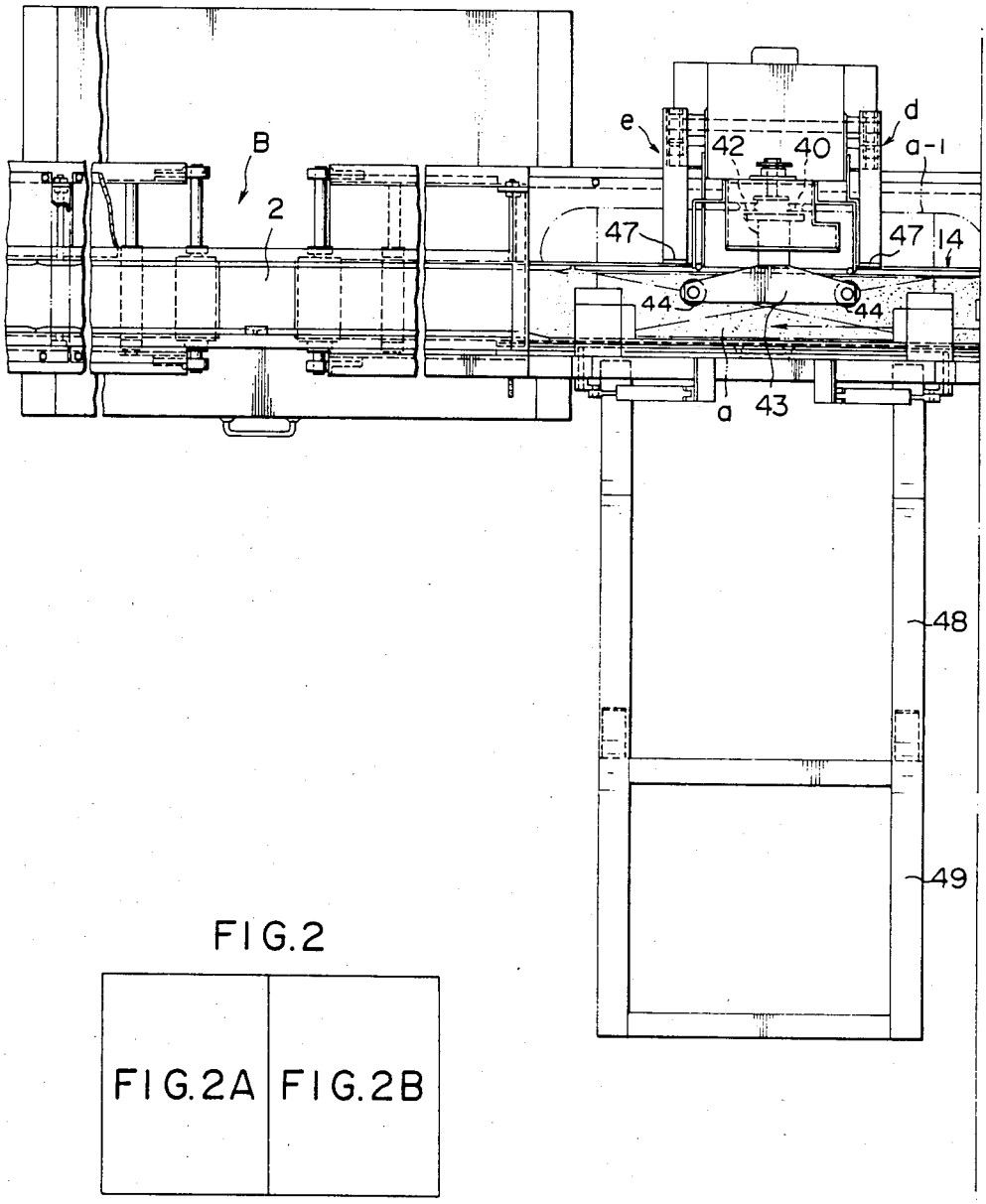
FIG. 2 is a plan view of FIG. 1.
Figure 2B:
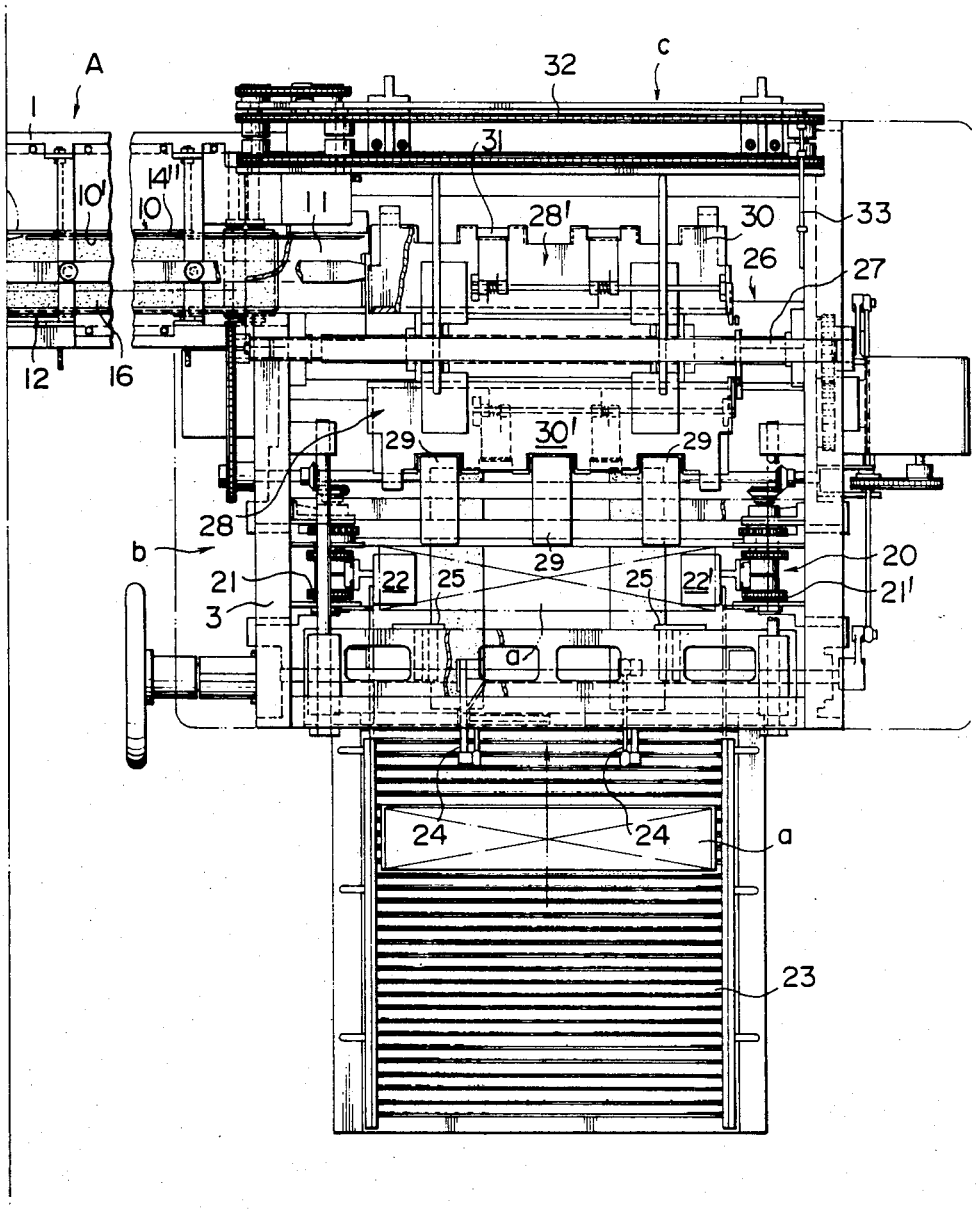
Figure 3:
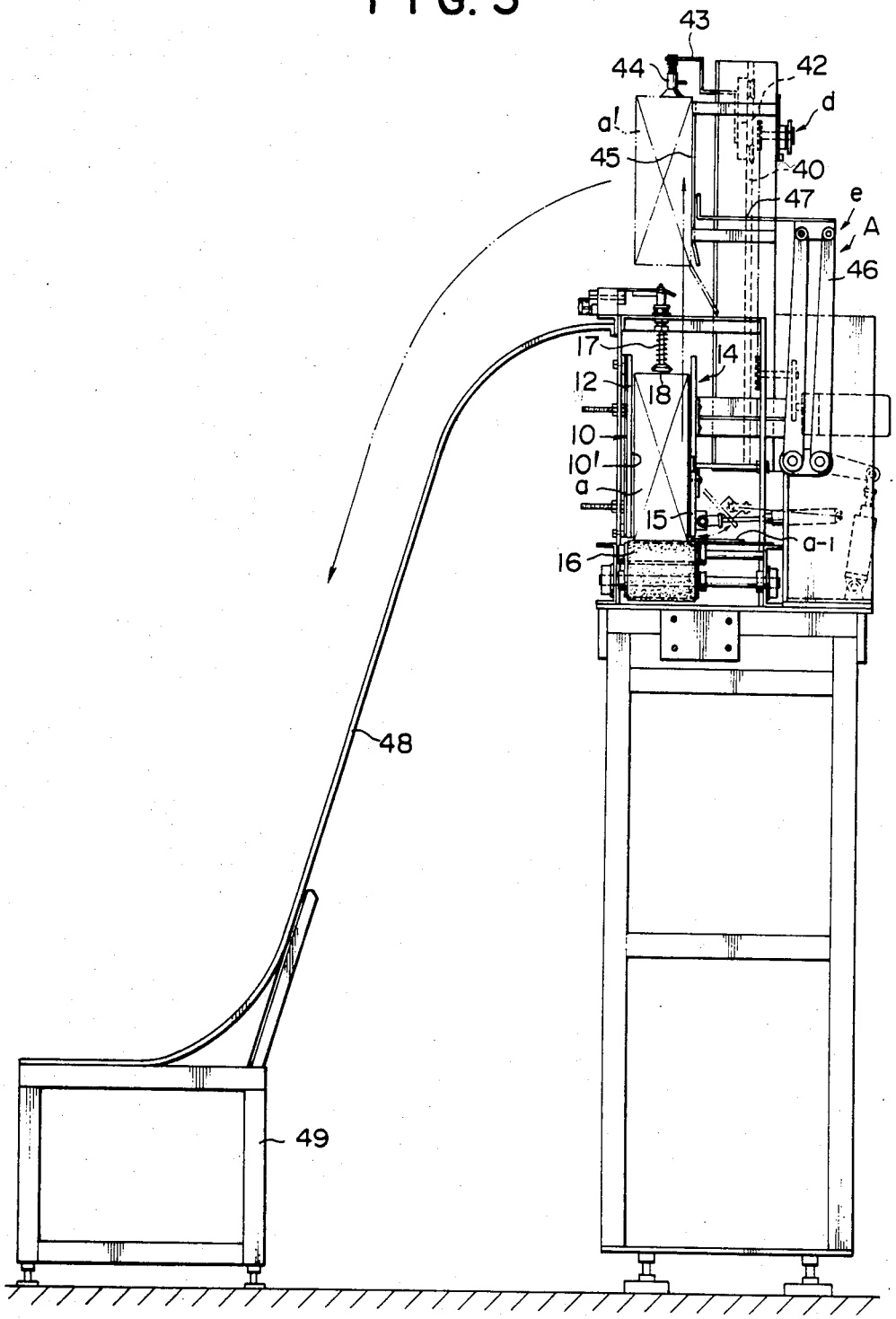
FIG. 3 is a side elevational view of the feeding apparatus, in which a box arranging device and a conveying device are removed.

The following discussion will be directed to an example in which filter plugs located in receiving boxes of cardboard are fed. In FIGS. 1 to 3, the feeding apparatus (A) essentially has a feeding framework 10, a box arranging device (b), a converging device (c), a box elevating device (d), and a blank box discharging device (e). The mark (a) designates plug receiving boxes. The framework 10 is provided on a machine frame 1 which in located above the floor surface.

The framework 10 is composed of opposed front and rear frame plates 12 and 14 which are spaced from one another and a belt conveyor 16 which forms a bottom surface of a flat feeding passage. The feeding passage 10' is defined by and between the frame plates 12 and 14 and is adapted to guide and convey the plug receiving boxes (a).

The length of the feeding passage 10' is such that two plug receiving boxes (a) connected in series can be moved therein at one time. The right half (FIG. 1) of the feeding passage 10' corresponding to the length of one plug receiving box (a) forms an introduction station (P) and the left half a feeding station (Q).

The front frame plate 12 is made of a transparent plate so that the plugs in the plug receiving boxes which open at the side facing the front frame plate 12 are visible. A window plate 13 is attached to the front frame plate 12 in the feeding station (Q) so as to open and close.

The rear frame plate 14 is composed of a flat plate 14' provided in the feeding station (Q) and a band plate 14" provided in the introduction station (P). The band plate 14" may not be flat, since the receiving box per se forms a rear wall of the feeding passage 10' at the introduction station (P). The flat plate 14' of the rear frame plate 14 is provided, at its lower end, with a swing plate 15 which can swing backward.

The ceiling of the feeding passage 10' is formed by a top plate 18 which extends only in the introduction station (P) and which is continuously biased downward by springs 17.

The belt conveyor 16 is constructed so that the conveying surface thereof intermittently moves toward the feeding station (Q) from the introduction station (P). The starting end of the belt conveyor 16 is connected to a stationary bottom plate 11 having a proper length which defines the bottom surface of the feeding passage 10', together with the belt conveyor 16.

The feeding framework 10 is connected, at its one end, i.e. at its left end in FIG. 1, to a storing device 2 of a plug transporting machine (B). The box arranging device (b) and the conveying device (c) are provided on the other end of the feeding framework. At the feeding station (Q), the box elevating device (d) and the blank box discharging device (e) are provided on the feeding framework 10.

Figure 4:
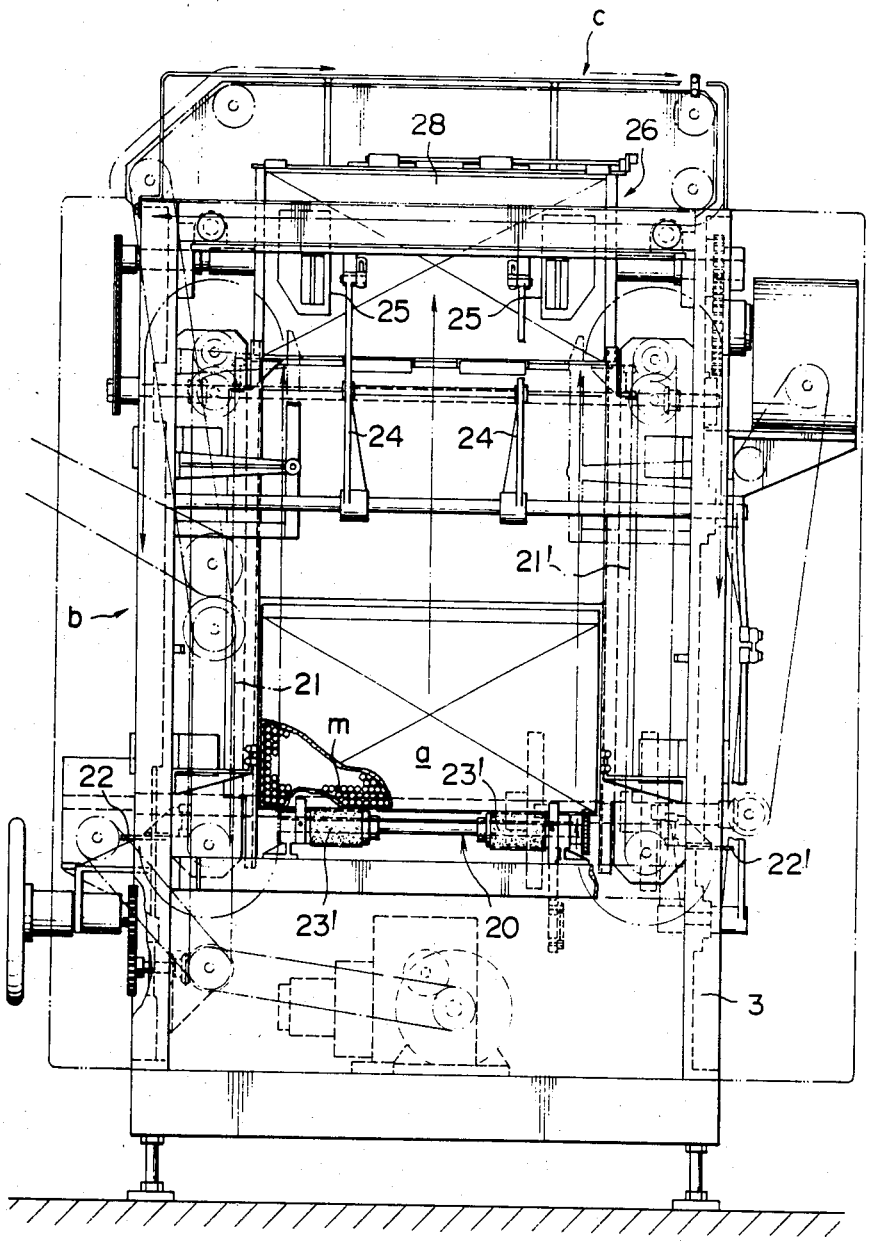
FIG. 4 is a front elevational view of the box arranging device and the conveying device.
Figure 5:
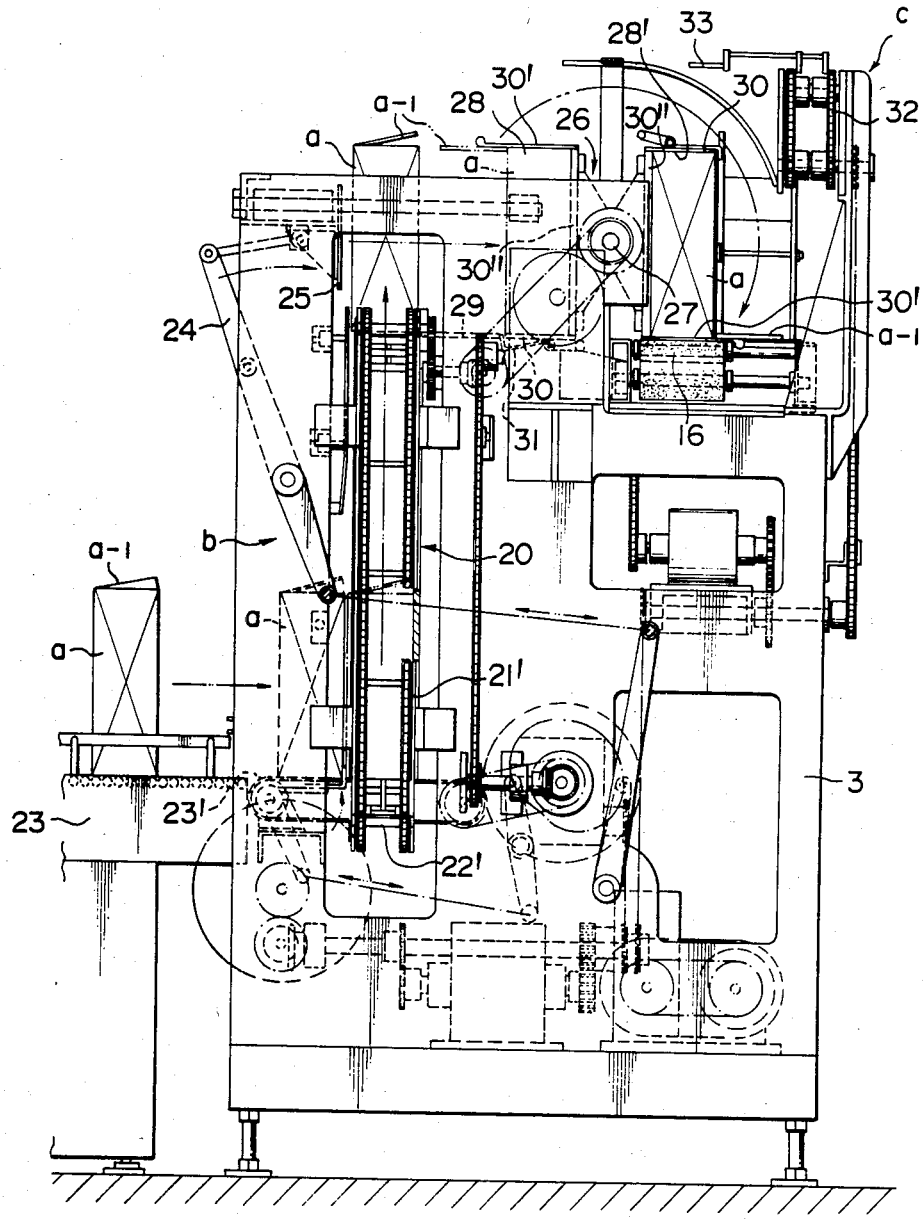
FIG. 5 is a partial side elevational view of FIG. 4.

The box arranging device (b) has, as shown in FIGS. 4 and 5, a lifter 20 provided on the machine frame 3, pushing arms 24, and a rotatable frame 26. The lifter 20 is composed of a pair of right and left lifting chains 21 and 21' which rotate to move up and down. The lifting chains 21 and 21' are spaced from one another by a distance substantially corresponding to the width of the plug receiving box (a) and have lifting plates 22 and 22' projecting in opposite directions.

On the lower end of the lifter 20 is provided an introduction conveyor 23' which is connected to a conveying passage 23 for successively conveying the receiving boxes (a). The conveyor 23' extends in the horizontal direction between the lifting chains 21 and 21' at the lower end of the latter so as to successively feed the plug receiving boxes (a) to the lower end of the lifter 20. The lifter 20 lifts the receiving boxes which are conveyed thereto by the conveyor 23' and which are engaged by the lifting plates 22 and 22' when the latter move upward.

The pushing arms 24 swing forward and backward in front of the lifter 20. The pushing arms 24 are provided, on their upper ends, with projecting pusher plates 25 integral therewith which reciprocally move forward and backward and transversely of the lifter 20.

The pushing arms 24 swing after the lifting plates 22, 22' come to their upper limit and stop there, so that when the pushing arms 24 swing backward, the receiving boxes (a) can be pushed toward the rotatable frame 26. The rotatable frame 26 rotates by 180° about a shaft 27 which is located at the upper and rear portion of the lifter 20. The rotatable frame 26 is provided, on its front and rear surfaces, with generally U-shaped reversible frames 28 and 28'. The reversible frames 28 and 28' occupy an upright position in which they face forward and an inverted position in which they face backward. The opposed reversible frames 28, 28' have bottom plates 30 which are substantially flush with the lifting plates 22, 22' of the lifter 20 which is located at the upper limit, in the upright position mentioned above, and ceiling plates 30' which are substantially flush with the bottom plate 11 of the feeding framework 10 (FIG. 1).

The numeral 29 in FIG. 5 designates a bridging plate between the bottom plates 30 of the reversible frames 28, 28' in the upright position and lifting plates 22, 22' which are located at the upper limit. The bottom plates 30 of the reversible frames 28, 28' have engaging abutments 31 which can project therefrom and retract therein to selectively come into engagement with the receiving boxes (a).

The receiving boxes (a) which are raised up to the upper limit position by the lifter 20 which comes to its upper limit are pushed into the U-shaped frame of the reversible frame 28 or 28' of the rotatable frame 26 when the forward movement of the pushing plates 25 takes place, so that the engaging abutments 31 project to engage with the lower ends of the receiving boxes (a) and then the rotatable frame 26 rotates through 180° to bring the receiving boxes in an inverted state.

The receiving boxes (a) are made of cardboard and have open front faces, as mentioned before. The plug receiving boxes (a) have at their upper faces, lids a-1 which can open and close to receive the plugs (m) therein. When the receiving boxes (a) are fed in the conveying passage 23, the upper lids a-1 are slightly open (FIG. 5). However, the lids a-1 are folded by the ceiling plate 30' of the reversing frame 28 or 28' which comes into contact with the upper lids a-1 when the receiving boxes (a) are pushed into the reversible frame 28 or 28', so that the upper faces of the receiving boxes are fully opened and the receiving boxes are held in the reversible frame 28 or 28'. It should be noted that the open front faces of the receiving boxes are closed by a rear plate 30'' of the reversible frame 28 or 28'.

The receiving boxes (a) are fitted in and held by the reversible frame 28 or 28' in the upright position thereof, and are held in an inverted state by the reversible frame 28 or 28' in the inverted position of the associated reversible frame 28 or 28'.

The conveying device (c) has a chain conveyor 32 with a pusher which is located in the rear of the rotatable frame 26. The chain conveyor 32 intermittently rotates. The pusher 33 is integrally connected to the front portion of the conveyor 32 and projects therefrom so that the pusher 33 passes through the reversible frame 28 or 28' and comes to the feeding passage 10'.

The conveying device (c) pushes the receiving box (a) which is held in the reversible frame 28 or 28' in an inverted state by means of the pusher 33, so that the receiving box comes out of the associated reversible frame and is moved to the introduction station (P) of the feeding passage 10'.

The conveying device (c) begins operating in accordance with detection 100 signals of a detector which detects the decreased amount of the receiving boxes stored in the storing device 2. The conveying device (c) stops operating when it has finished feeding one receiving box arranged in an inverted state from the inverted position to the introduction station (P) and then waits for the next detection signals from the detector. It is also possible to introduce one receiving box by several intermittent movements. When the conveying device operates, the box arranging device (b) also operates in association with the operation of the conveying device (c), so that the rotation of the rotatable frame 26 causes a fresh plug receiving box (a) to be brought from the upright position to the inverted position, and the receiving box which has been lifted by the lifter 20 is pushed into the reversible frame 28 or 28' which has been returned to the upright position, by means of the pusher arms 24.

The lifting device (d) is provided on a frame 4 which is located in the rear of the feeding station (Q) of the feeding passage 10. The frame 4 (FIG. 1) has a vertically extending guide passage 40 in which an endless chain 41 is provided for upward and downward movement. The endless chain 41 has an elevating element 42 which engages therewith so as to move up and down together with the endless chain along the guide passage 40. The elevating element 42 has a box elevating arm 43 integral therewith. The box elevating arm 43 has left and right ends which project above the feeding station (Q) of the feeding passage 10' and which are provided with suction elements 44. The suction elements 44 have vacuum suction lower surfaces which suck the receiving boxes when desired.

The suction elements 44 move up and down together with the elevating element 42 and come into contact with the upper surface of the receiving box located at the feeding station (Q) to suck the same when the suction elements 44 come to their lower positions. After that, the suction elements 44 move upward while sucking the receiving box, and stop at its upper limit.

When the receiving boxes are elevated, the plugs (m) in the receiving boxes are discharged therefrom into the feeding passage 10' through the bottom faces of the receiving boxes which open. After that, the blank boxes (a') are elevated onto the feeding frame 10.

The numeral 45 designates keep levers which project forward from the frame 4 to come into contact with the rear surfaces of the blank boxes (a') in order to support the latter.

The blank box discharging device (e) has pusher arms 46 which are provided to the rear portions of the frame 4 on the opposite sides thereof to swing forward and backward and which are provided, on their upper ends, with pushers 47 which extend forward in the horizontal direction from the pusher arms 46. The front ends of the pushers 47 are located slightly to the rear of the keep levers 45.

To the upper edge of the front frame plate 12 in front of the feeding frame 10 is attached a curved blank box receiving frame 48 which extends smoothly forward and downward therefrom and which is connected, at its lower end, to a receptacle 49.

The discharging device (e) discharges the blank box (a') conveyed on the feeding frame 10 by means of the suction elements 44 of the box lifting device (d), onto the blank box receiving frame 48 by the forward movement of the pushers 47 of the pusher arms 46. When the pushers 47 come into collision with the rear surface of the blank box (a'), the suction elements 44 stop operation, that is, a vacuum is no longer fed to the suction elements 44.

Figure 6:
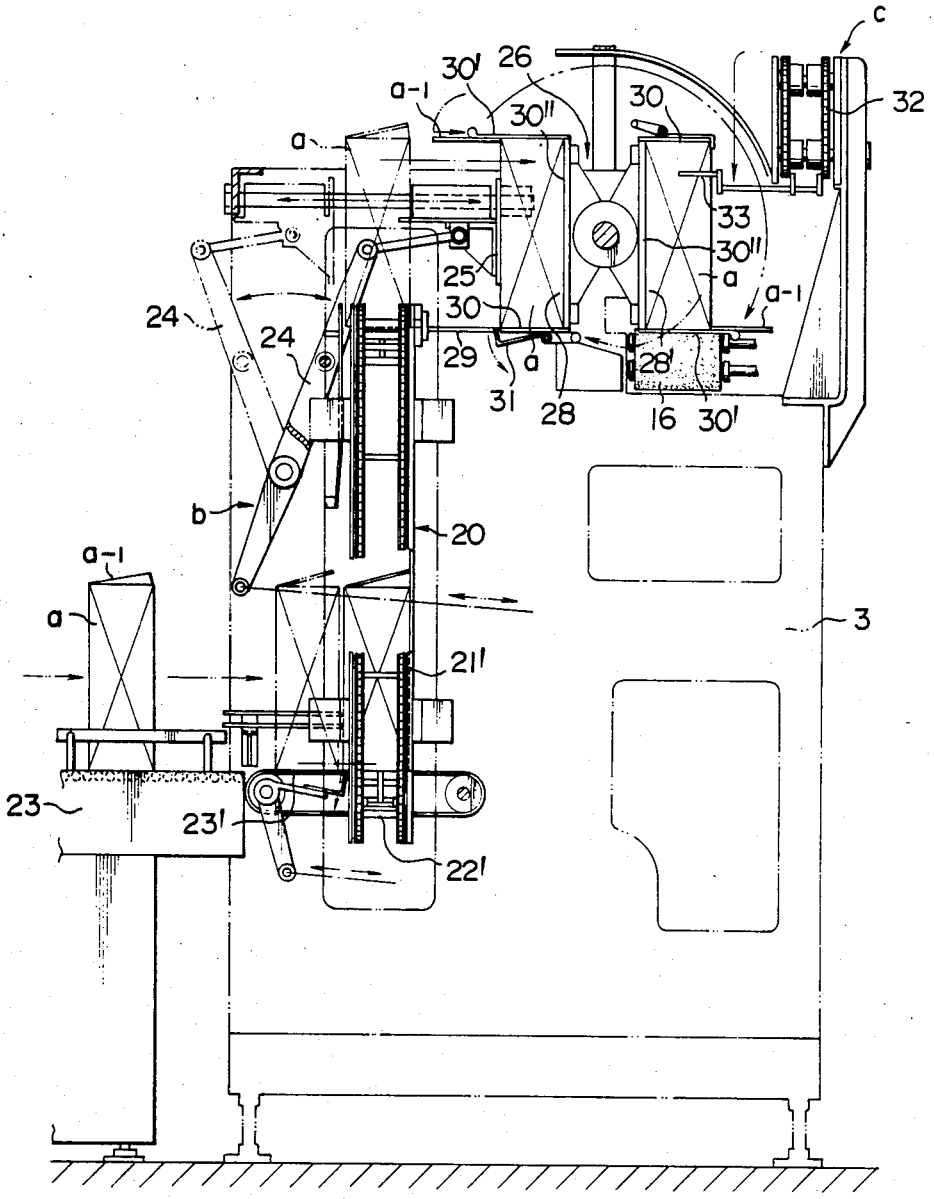
FIG. 6 is a side elevational view for explaining the step of arrangement of the bar-like material receiving boxes.
Figures 7, 7A:
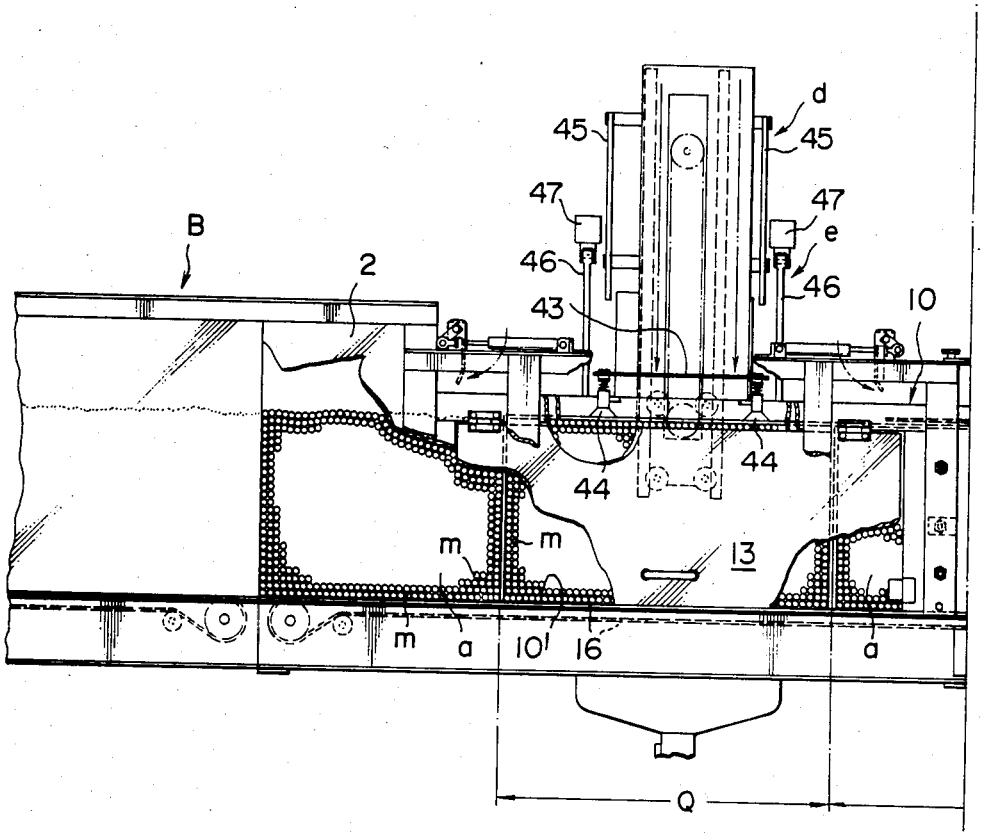
FIGS. 7 and 8 are partially broken front elevational views of the apparatus for showing the conveyance and the feed of the bar-like materials, respectively.
Figure 7B:
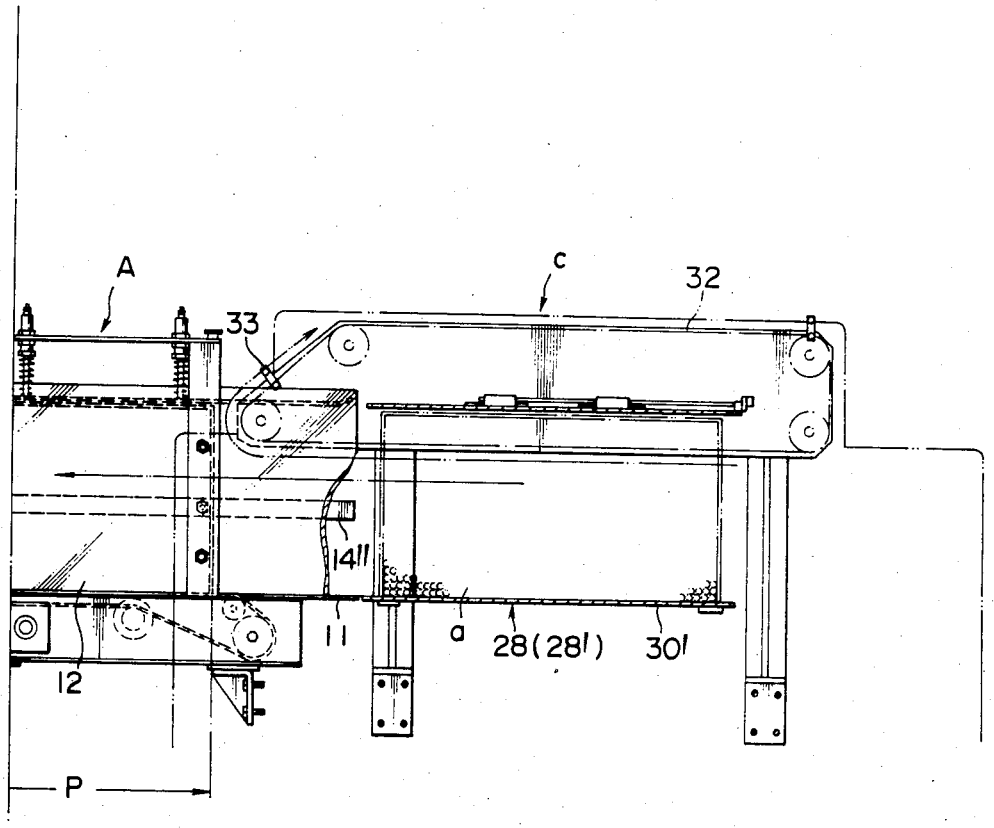

The apparatus of the present invention operates as follows. With reference to FIGS. 6–10, the receiving box (a) which come to the lower portion of the lifter 20 from the conveying passage 23 through the introduction conveyor 23' is raised, by means of the lifter 20, to the upper limit where the receiving box is pushed into the reversible frame 28 or 28' which occupies the upright position while the upper face of the box is maintained open, by the forward movement of the pushing plates 25. After that, the rotation of the rotatable frame 26 through 180° causes the reversible frame 28 or 28' to be brought to the inverted position, so that the receiving box (a) is inverted and comes to the inlet end of the feeding passage 10' (FIGS. 6 and 7). When the box is located at the inlet end of the feeding passage 10', the box has an open bottom which was the open upper face, and which is now closed by the coiling plate 30' of the reversible frame 28 or 28'.

In accordance with the detection signals from the detector (not shown) which detects when the amount of the plugs stored in the plug storing device 2 is below a predetermined value, the chain conveyor 32 of the introduction device (c) operates to move the pusher 33 which in turn, moves the receiving box in the reversible frame 28 or 28' toward the feeding frame 10, so that the receiving box (a) comes to the introduction station (P) through the bottom plate 11 of the feeding passage 10' (FIG. 7).

In association with the operation of the introduction device (c), the lifter 20, the pushing arms 24, and the rotatable frame 26, of the box arranging device (b) operate in turn to effect the respective operations as mentioned before, to bring a fresh (subsequent) receiving box to the inlet end of the feeding passage 10.

After a lapse of a predetermined time from the commencement of the operation of the introduction device (c), i.e. when the receiving box (a) moves on the bottom plate 11 of the feeding passage 10' and comes to the belt conveyor 16, the latter begins moving to introduce the receiving box into the introduction station (P) with the help of the pusher 33. After that, the belt conveyor 16 stops.

Figures 8, 8A:
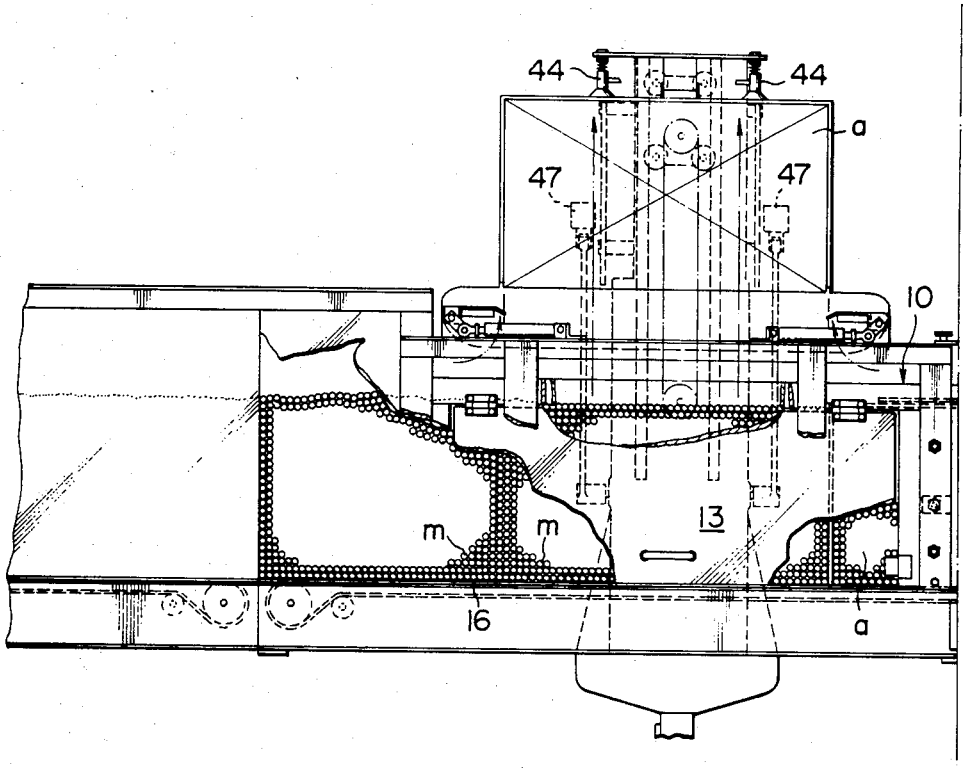
Figure 8B:
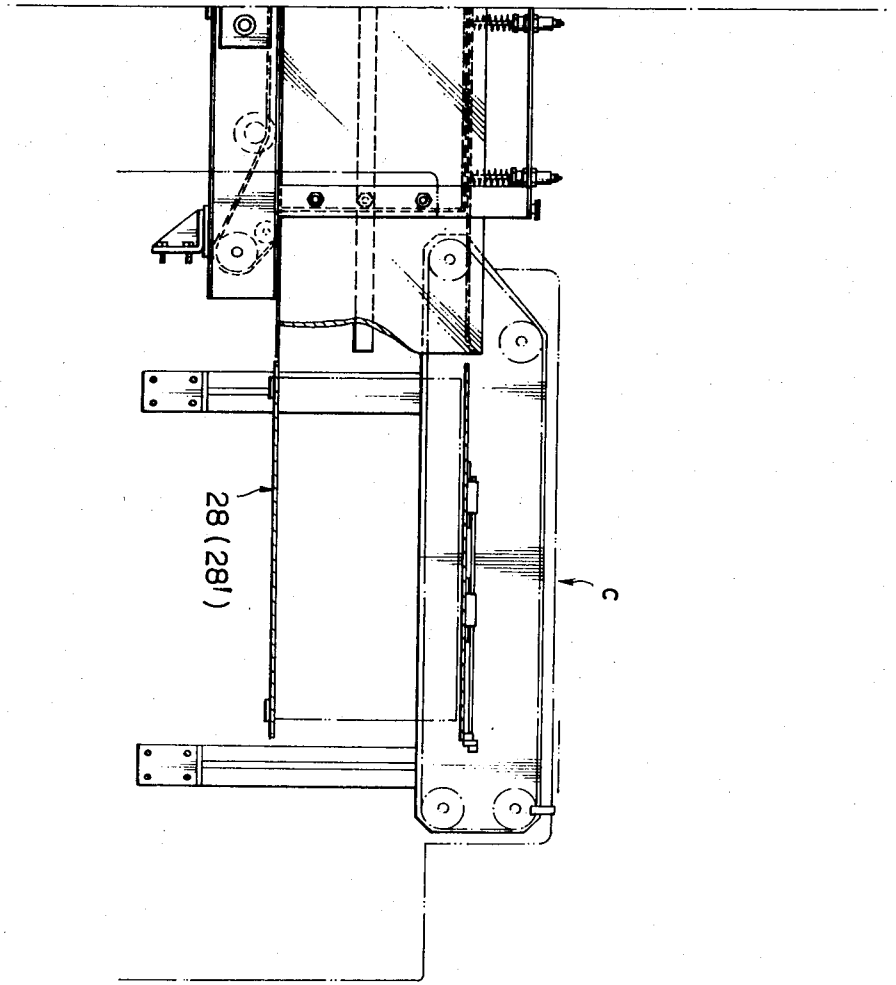
Figure 9:
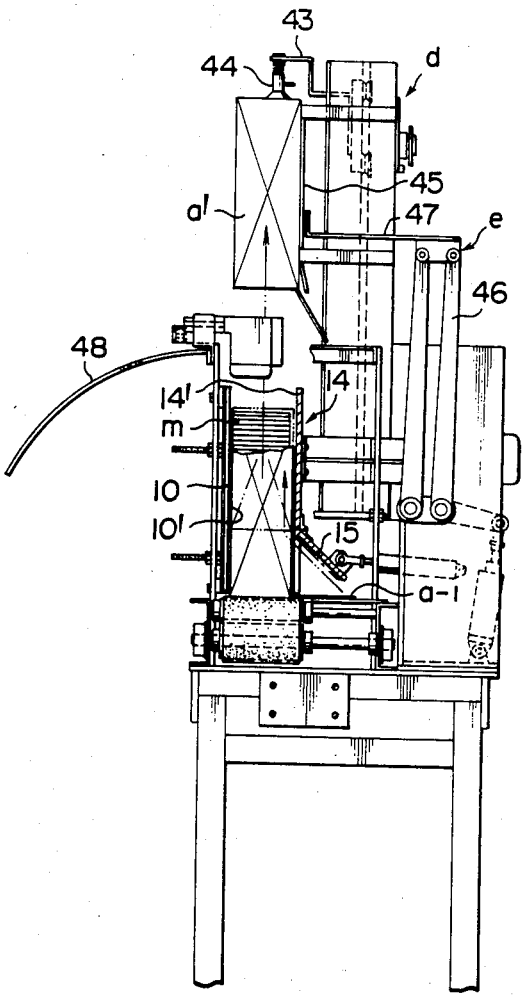
FIG. 9 is a side elevational view of the apparatus for explaining the feed of the bar like materials; and, FIG. 10 is a side elevational view of the apparatus for explaining the discharge of a blank receiving box.

When the subsequent receiving box is brought to the introduction station (P) similarly to the foregoing, the preceding receiving box comes to the feeding station (Q) by means of the belt conveyor 16 (FIG. 7). When the belt conveyor 16 stops after the preceding receiving box comes to the feeding station (Q), the suction elements 44 lower until they come into contact with the upper surface of the receiving box located in the feeding station (Q), so that the suction elements 44 suck the receiving box (a). The suction elements 44 move upward to raise the receiving box to the upper limit (FIGS. 8, 9). During the upward movement of the receiving box, the plugs (m) in the receiving box (a) are discharged into the feeding passage 10' at the feeding station (Q).

When the plugs are discharged or fed, the subsequent receiving box forms one side wall which defines and closes the feeding passage 10' at the feeding station Q (FIG. 8).

Furthermore, during the upward movement of the receiving box, the swing plate 15 of the rear frame plate 14 temporally moves to open so that the upper lid a-1 of the receiving box (a) that projects out of the feeding passage 10' can easily come into the feeding passage 10' (FIG. 9). The swing plate 15 moves to gradually close as the upper lid (a-1) is raised (FIG. 8).

Figure 10:
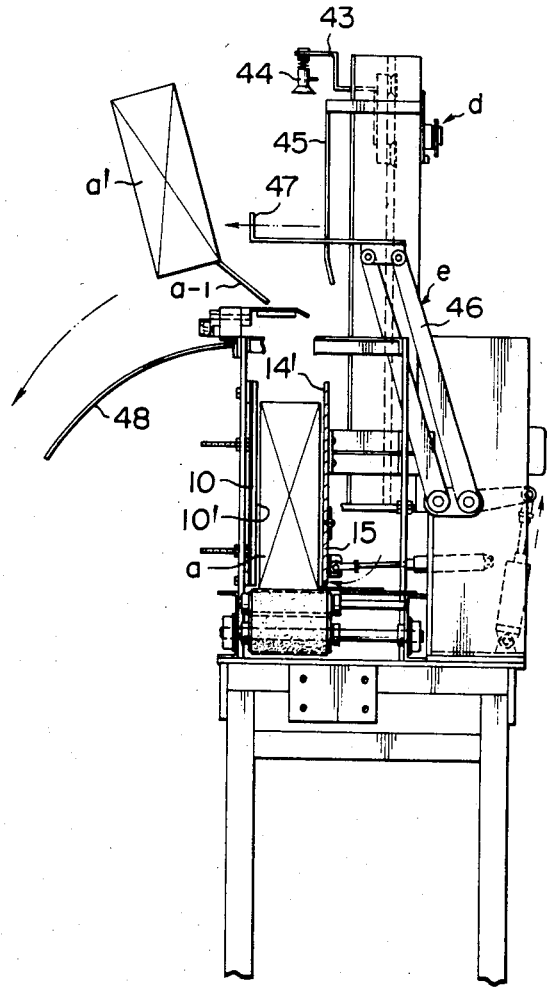

The blank box (a') which has been raised by the box lifting device (d) is discharged onto the blank box receiving frame 48 by means of the pushers 47 of the discharging device (e) (FIG. 10).

The plugs (m) which have been discharged onto the feeding passage 10' are conveyed toward the storing device 2 when the subsequent receiving box is fed onto the feeding passage 10', by the belt conveyor 16 and by the receiving box which moves from the introduction station (P) to the feeding station (Q).

It should be noted that although the belt conveyor 16 is provided on the bottom of the feeding passage 10', in the illustrated embodiment, an immovable bottom plate can be provided on the bottom of the feeding passage, in place of the convyor belt. In this alternative, the receiving boxes can be successively pushed by the subsequent receiving boxes on the immovable bottom plate. However, the belt conveyor contributes to a smooth conveyance of the receiving boxes (a) and the plugs (m).

We claim:

1. An apparatus for feeding bar-like materials, comprising:

a feeding frame which forms a flat bottomed feeding passage, means located at an inlet end of the feeding passage for containing the bar-like materials in layered form across the feeding passage, means for inverting receiving boxes which contain the bar-like materials therein and which have open upper faces, means on the feeding frame for collectively feeding the bar-like materials in each receiving box to the feeding passage by lifting each receiving box which comes to a predetermined position in the feeding passage, means on the feeding frame for discharging each lifted receiving box which is now blank, from the feeding frame, and means located at the inlet end of the feeding passage for successively conveying the inverted receiving boxes, one by one, to the feeding passage, in at least a closely adjacent relation to each other such that the discharged bar-like materials in layered form across the feeding passage are further contained by the next closely adjacent receiving box which forms a back wall for said discharged bar-like materials and such that said next closely adjacent receiving box transfers said discharged bar-like materials to a storing device during subsequent conveyance of said next closely adjacent receiving box to said feeding passage.

2. An apparatus according to claim 1, wherein said feeding passage comprises a bottom made of an intermittently movable belt conveyor.

3. An apparatus according to claim 1, wherein said feeding passage comprises a bottom made of an immovable plate and an intermittently movable belt conveyor connected to the immovable plate.

4. An apparatus according to claim 1, wherein said feeding passage has a length sufficient to receive two receiving boxes located in series, one half thereof forming a feeding station and the other half forming an introduction station.

5. An apparatus according to claim 4, further comprising a fixed frame provided in rear of the feeding station of the feeding frame, wherein said receiving box lifting means is located on said fixed frame, said lifting means comprising a vertically extending guide passage in the fixed frame, an endless chain arranged in the guide passage so as to move up and down, said endless chain being provided with at least one elevating element connected thereto so as to move together with the endless chain, said elevating element having at least one suction element which sucks the receiving box to lift the same.

6. An apparatus according to claim 5, wherein said said blank box discharging means comprises pusher arms which are provided on the opposite rear sides of the fixed frame and which can swing forward and backward, said pusher arms being provided, on their upper ends, with pushers projecting forward therefrom in the horizontal direction, said pushers having front ends which are located in rear of the blank box which has been raised by the box lifting means.

7. An apparatus according to claim 1, further comprising a machine frame, wherein said means inverting comprises a lifter, pusher arms, and a rotatable frame, all provided on the machine frame, said lifter comprising a pair of lifting chains which rotate to move up and down and which are spaced from one another by a distance substantially corresponding to the width of the receiving boxes, said lifting chains having lifting plates projecting in opposite directions, said lifting plates coming into engagement with one receiving box when the lifting plates are raised, said pusher arms being capable of swinging movement forward and backward in front of the lifter, said pusher arms being provided, on their upper ends, with pusher plates which move forward and backward and transversely of the lifter, so that when said lifting plates of the lifter move upward until they reach their upper limit, the pusher plates swing to push the receiving boxes into the rotatable frame, said rotatable frame having at its front and rear faces generally U-shaped reversible frames and being capable of rotation through 180° to selectively occupy an upright position where a bottom plate of the associated reversible frame is substantially flush with the lifting plates located at the upper limit and an inverted position where a top plate of the associated reversible frame is substantially flush with the bottom of the feeding frame.

8. An apparatus according to claim 7, wherein said conveying means comprises a chain conveyor having pushers located in rear of the rotatable frame, said chain conveyor being capable of intermittent rotation to push the receiving box held in the associated reversible frame in an inverted state, by means of the pusher in order to discharge the receiving box from the associated reversing frame into an introduction station of the feeding passage.

9. An apparatus according to claim 8, further comprising means for storing the receiving boxes and means for detecting the amount of the receiving boxes in the storing means, wherein said conveying means operates in response to detection signals from detecting means when the amount of the receiving boxes in the storing means is below a predetermined value, to convey one inverted receiving box in the inverted position.

* * * * *